US005343568A

United States Patent [19]

May

[11] Patent Number: 5,343,568

[45] Date of Patent: Sep. 6, 1994

[54] FLIP VISOR FOR HEADGEAR

[76] Inventor: Nina O. May, 2338 Walnut St., Falls Church, Va. 22046

[21] Appl. No.: 60,643

[22] Filed: May 13, 1993

[51] Int. Cl.[5] ..... A42B 1/00

[52] U.S. Cl. ..... 2/195.1; 2/209.13

[58] Field of Search ..... 2/10, 12, 15, 171, 175.1, 2/195.1, 195.5, 195.6, 209.11, 209.12, 209.13; 40/329; 446/26, 27, 148

[56] References Cited

U.S. PATENT DOCUMENTS

| | | | |
|---|---|---|---|
| D. 258,323 | 2/1981 | Lewis . | |
| D. 284,328 | 6/1986 | Bieber . | |
| 911,126 | 2/1909 | Harrison et al. . | |
| 2,648,847 | 8/1953 | Crowder . | |
| 2,735,109 | 2/1956 | Feldman . | |
| 3,228,139 | 1/1966 | Lohnes . | |
| 4,321,708 | 3/1982 | Troiano . | |
| 4,793,006 | 12/1988 | Dawson . | |
| 4,985,935 | 1/1991 | Hur | 2/195.5 |
| 5,197,150 | 3/1993 | Bedient | 2/195.1 |

*Primary Examiner*—Clifford D. Crowder
*Assistant Examiner*—Diana L. Biefeld
*Attorney, Agent, or Firm*—Watson, Cole, Grindle & Watson

[57] ABSTRACT

A headgear includes a lower visor lid member and a flexible upper visor lid member connected to one another in a region where both members are attached to the headgear, the upper visor lid member being flexible and weakened along an area which enables the flexible upper visor lid member to be separated from the lower visor lid member to an open position, the flexible upper visor lid member including a protruding portion of the visor lid member that overlaps the lower visor lid member when the visor lid members are closed on one another, thereby enabling the protruding portion to be grasped by the wearer so that the flexible upper lid member may be separated from the lower visor lid member; a storage space being provided between the closed upper and lower visor lid members for containing display and/or storage; and the lower visor member includes a protrusion formed thereon in the region near where the upper and lower visor lid members are attached so that a lower portion of the upper visor lid member pushes against and over the protrusion upon opening of the upper visor lid member to maintain the flexible upper visor lid member in an open position. Alternatively, the protrusion may be at least two speed bumps formed on the lower visor member and spaced from one another along the width of the lower visor member in a region below the weakened area of the upper visor member and where the upper visor member engages the lower visor lid member.

16 Claims, 2 Drawing Sheets

FIG. 5A
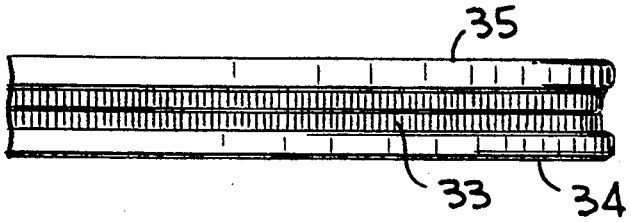
FIG. 5B
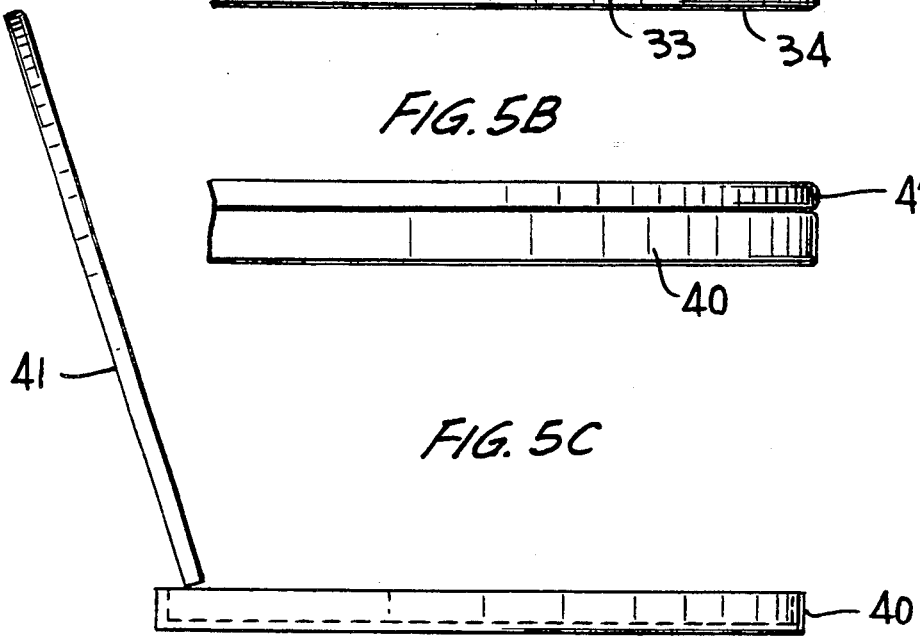
FIG. 5C
FIG. 6A
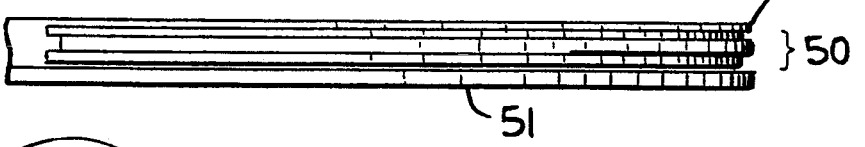
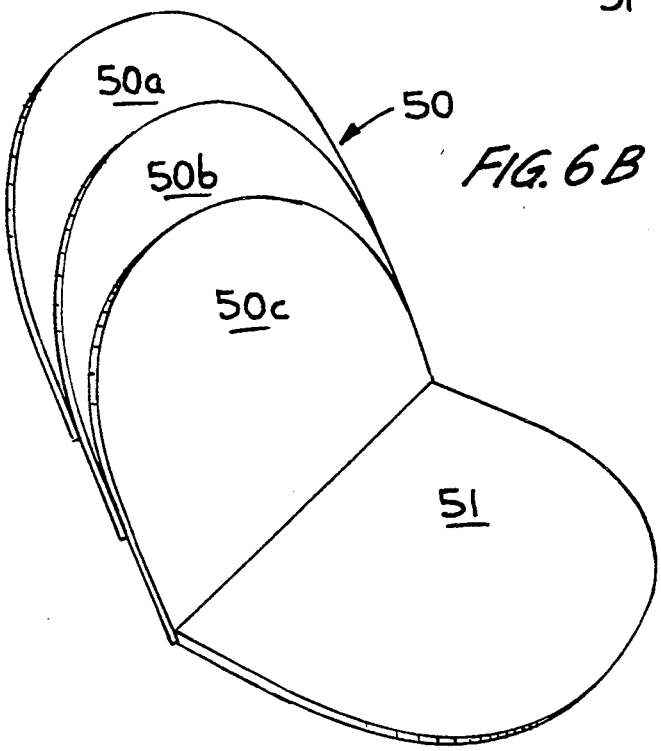
FIG. 6B

FLIP VISOR FOR HEADGEAR

BACKGROUND OF THE INVENTION

1. Field of the Invention

This invention relates to visors of the flip-opening type for headgear, and more particularly to such headgear in which the visor comprises two overlapping members with the bottom member being stationary and the top member designed to flip up to provide space for advertising, storage or three-dimensional charactures, and more particularly to such visors with improved structure enhancing the opening, separation and closing of the overlapping members, thereby improving the functional usefulness of such headgear.

2. Related Art

Cap visors having displays located between two separable members are known to the art. An Example of such cap visors is disclosed in U.S. Pat. No. 4,985,935 issued Jan. 22, 1991 in the name of Hur. Although the cap visor disclosed in this patent is an improvement over cap visors as shown in such references as U.S. Design Pat. Nos. 284,328 and 258,323 and 911,126, 2,475,471, 2,648,847 and 2,735,109, improvements can be made in the manner in which the overlapping bills separate, are retained separated and are closed. Additionally, such a cap visor can be improved to afford additional functions such as the storage of various items and as a compartment to house radios or cassettes.

SUMMARY OF THE INVENTION

Accordingly, it is an object of the invention to provide improvements in the opening and closing structures for flip-opening visors for headgear, and more specifically:

Limiting the overlap of the top visor lid with respect to the bottom visor lid to only that portion necessary to grasp the lid to lift it and separate it from the bottom lid and/or provide the upper and lower outer portions of the visor lids with a recessed angle, thereby exposing the upper visor lid for grasping to open it;

Using metal strips, VELCRO type fastenings, springs, magnets to retain the upper visor lid open;

Using the forces created by the natural curvature of the upper visor lid when it is pulled back over the bottom visor lid to automatically retain the upper visor lid in an open position;

Delete the plastic female/male closing snaps and replace them with with a plastic ridge, zip-lock type locking device;

Producing both upper and lower visor lids in a flexible, magnetic material suitable for printing to produce a magnetic closing force and/or using magnetic strips on each of the upper and lower visor lids to generate a magnetic closing force;

It is a further object of the invention to provide additional uses of flip-opening type visors for headgear, and more specifically:

Providing a storage area for articles such as keys between the upper and lower visor lids in the form of a pouch;

Installing a sound or light-emitting chip on either or both of the top and bottom visor lids which is activated by opening the top visor lid;

Installing solar energy chips on the upper surface of the headgear to power or recharge the sound or light-emitting chips or using a battery installed in the headgear to power the sound and light-emitting chips;

Printing specifically designed reading or publication material on the inside of the upper and lower visor lids;

Installing a portable, battery or solar energy-powered computer between the visor lids;

Installing listening receivers in any portion of the headgear including the visor lids; and Using telescoping upper visor lids.

BRIEF DESCRIPTION OF THE DRAWINGS

The above features, advantages and objects of the invention are believed to be readily apparent from the following description of preferred embodiments of the best mode of carrying out the invention when taken in conjunction with the following drawings, wherein:

FIGS. 2A and 2B illustrate an embodiment of the top and bottom visors in accordance with the invention in which FIG. 2A is a side view and FIG. 2B is a plan view of the visor elements;

FIGS. 5A, 5B and 5C illustrate an embodiment of the invention in which storage space is provided between the upper and lower visor elements; and FIGS. 6A and 6B illustrate respective side and elevation views of an embodiment of the invention wherein the upper visor element telescopes.

DETAILED DESCRIPTION OF THE EMBODIMENTS

Figure 1:
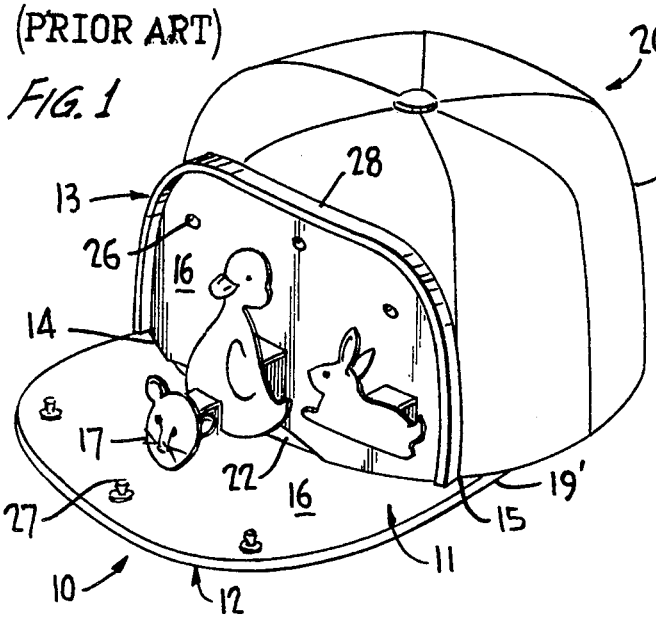
(PRIOR ART) FIG. 1
FIG. 1 illustrates a representative known headgear having certain features used in conjunction with the invention and showing an exemplary pop-up display that is revealed when the top visor lid is lifted.

FIG. 1 illustrates a representative known headgear of the type to which the present invention is related and which comprises a lower visor member 12, a foldable upper visor member 13 and a pop-up display means 11 located between the lower and foldable upper visor members 12 and 13. This type of headgear is described in U.S. Pat. No. 4,985,935, issued Jan. 22, 1991 to Hur. The lower and upper foldable visor members 12 and 13 are connected to each other in an area 14 where the cap visor 10 is attached to a cap 20. The foldable upper visor member 13 is foldable along a weakened area 15 which enables the foldable upper visor member 13 to be separated from the lower visor member 12 to an open position.

As described in the aforementioned HUR patent, the upper visor member 13 is provided with a peripheral lip 28 and the lower visor member 12 is slightly smaller than the foldable upper visor member 13 so that when the lower and foldable visor members are closed against each other the lower visor member 12 nestles within the foldable upper visor member 13 behind the peripheral lip 28. However, this "nesting" feature of the HUR cap visor display is disadvantageous in that it is difficult for the wearer of the headgear to lift up and separate the lower and upper visor members so that it becomes necessary to remove the headgear and separate the upper and lower visor members by both hands. This is a serious inconvenience to the headgear user as it would be very desirous to have the user be able to flip-up the upper visor member and separate it from the lower visor member while the headgear is attached to the user's head.

Figure 2A:
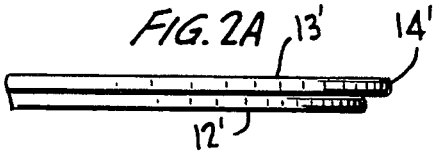
Figure 2B:
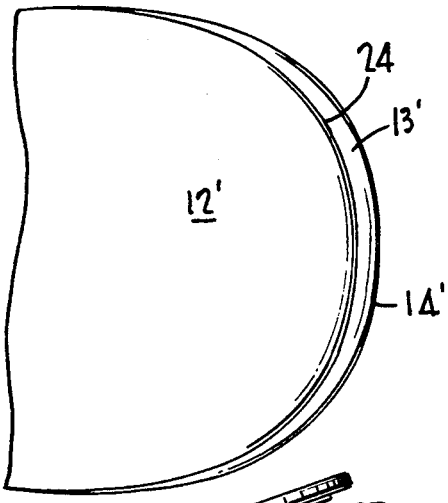

This problem is solved by an embodiment of the invention shown in FIGS. 2A and 2B in which top visor member 13' includes a top lid visor portion 14' that extends over the bottom lid visor portion 24 as shown in FIG. 2A. Preferably, the top lid visor portion 14 overlaps the bottom lid visor portion 24 near the front curve portion 26 of the top and bottom visor members as shown in FIG. 2B. The overlapping portion 26 enables the top visor member 14 to be grasped by the fingers of either hand of the headgear wearer to raise and separate the top visor member 13' from the lower visor member 12', thereby exposing the display as shown in FIG. 1.

While the overlapping portion of the upper visor member 14 with the lower visor member portion may preferably be limited to that shown in FIG. 2A and 2B, the invention contemplates such an overlapping portion that is greater in extent, even extending all around the periphery of the visor members to the point (not shown) where they meet the main portion of the headgear. However, the most advantageous place for the overlapping of the visor members is in the front portion 26 illustrated in FIG. 2B.

Figure 3A:
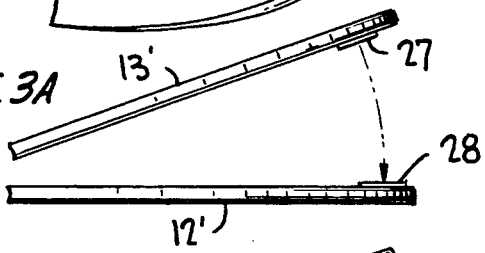
FIGS. 3A and 3B illustrate respective side views of two different type of fastening means used in accordance with the invention.
Figure 3B:
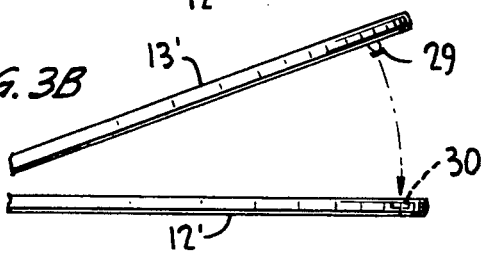

FIGS. 3A and 3B illustrate two different alternative embodiments for providing a closure for the upper and lower visor members 12' and 13'. In FIG. 3A the closure means comprises a pair of magnets 27 and 28, respectively mounted on the upper and lower visor members 13' and 12' so that when the visor members are closed the magnets provide a closing force to maintain the upper and lower visor members 12' and 13' in a closed relationship and yet enable them to be readily separated by the headgear wearer.

In FIG. 3B the closure member comprises a single male/female snap with the male snap member 29 fastened to the top visor member 13' and the female snap member fastened to the lower visor lid member 12'. In both the embodiments of FIGS. 3A and 3B, the fastening closure members are mounted so that they are hidden from view when the lower and bottom visor lid members 13' and 12' are in a closed position.

A further alternative embodiment is to have no closure member at all, for example, as shown in FIGS. 2A and 2B, and in such a case it is apparent that the top and lower visor members should be formed with a tendency to spring shut when the visor members are within a given distance of being closed. This is within the capability of the art of visor-making as there are materials used for headgear manufacture that have such characteristics.

Figure 4A:
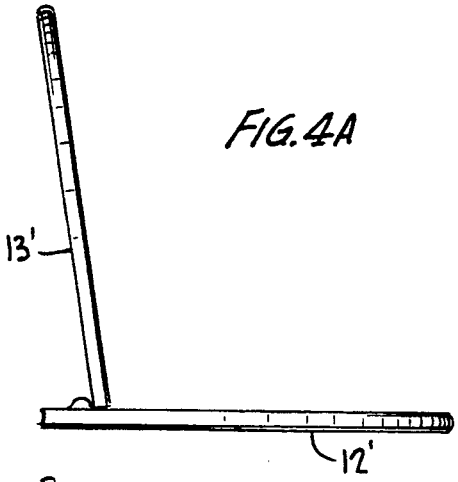
FIGS. 4A, 4B and 4C illustrate respective embodiments of structure for controlling the open position of the upper visor in accordance with the invention.
Figure 4B:
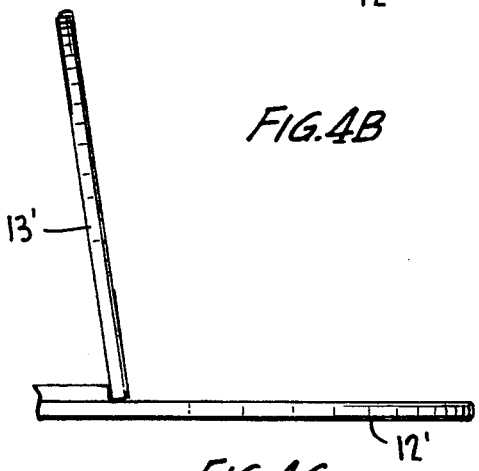
Figure 4C:
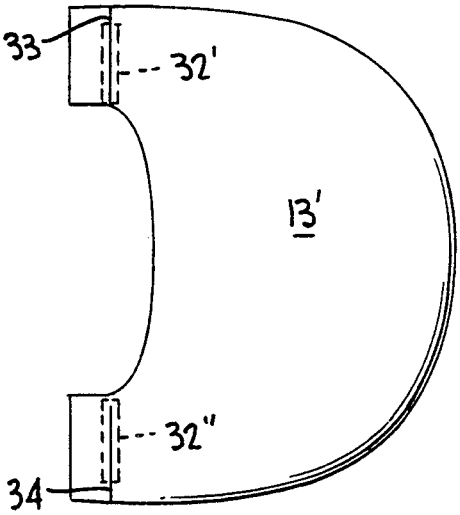

FIGS. 4A, 4B and 4C represent separate embodiments of means for causing the upper visor lid member to remain in an opened position. In FIG. 4A the lower lid visor member 12' includes a "speed bump" or protrusion 32 that is positioned at the base of where the upper lid visor member 13' engages the lower visor lid member 12' so that the lower portion of the upper visor lid member 13' pushes against and over the speed bump 32 to remain open.

FIGS. 4B and 4C illustrate yet another embodiment of means for enabling the top visor lid to remain in an open position. As shown in these Figs. the top visor lid member 13' is cut so as to be weakened and to provide natural break lines 33, 34 on each side of the top visor lid member 13' as shown in FIG. 4C. Thus when the top visor lid member 13' is forced upwardly, the natural curve of the top visor lid member 13' actually provides a force to retain the visor lid member open. The retention of the upper visor lid member 13' may also be assisted by the provision of a spaced pair of "speed bumps" each "speed bump" 32' and 32'' being shown in phantom in FIG. 4C and formed on the lower visor lid member 12' directly below a respective natural break line 33, 34 of the upper visor lid member 13'.

FIGS. 5A, 5B and 5C respectively illustrate three different embodiments of a modification of the headgear to provide a storage space between the closed upper and lower visor members 35 and 36. In these embodiments it is not necessary to provide an overlapping portion between the upper and lower visor lid members 35 and 36 as the separation between these members in the closed position provides a sufficient area in which to grasp the upper visor lid member 35 and separate it from the lower visor lid member 36.

In FIG. 5A, each of the upper and lower visor lid members 35 and 36 is provided with an extension 37 and 38 to form a storage pouch with an intervening zipper 39 serving as a fastening means. Small items such as keys, pens, identification cards, driver's licenses, etc., could be temporarily carried in the storage pouch. In the modification shown in FIG. 5B, the storage area or pouch is formed primarily by the lower visor lid 40 with the upper visor lid 41 having a protruding lip member 42 enabling the upper and lower visor lids to be separated. The top and bottom visor lid members 40 and 41 can be sealed by a zipper mechanism, VELCRO-type fasteners, magnets, snaps or any sealing device known to the trade.

As shown in FIG. 5C there is no need for the top visor lid 41 to remain open because the storage space is not for display, but to hide and store items conveniently. However, if desired a flat display can be provided on the under surface of the top visor lid member, in which case similar means as described herein can be employed to retain the upper visor lid in an open position to provide observance of the display.

It is possible that the storage space between the upper and lower visor lid members can be used to attach miniature radios, cassette players, miniature computers, etc. It is further possible that the storage area could be employed to house pop-up displays having greater density and complexity due to the thickness of the storage area as compared with two visor lid members not having such capacity. Thus, the headgear provided with such a storage area could be used in conjunction with headphones in a manner similar to that of "WALKMAN" type systems now currently in use.

The incorporation of batteries in the storage area will also permit electrical light displays for advertising and promotional functions to be employed in the headgear.

The remaining embodiment of the invention relates to an extend-a-lid assembly as illustrated in FIGS. 6A and 6B. In FIG. 6A a top visor lid member group 50 having individual sections **50*a* and 50*b* telescoping under top visor lid member 50*c* as shown in FIG. 6B, is fastened in an open position with bottom visor lid member 51. The upper visor lid member 50*a* may include a protruding portion 52 to assist in separating the visor lid members as previously described with respect to FIGS. 2A and 2B. The upper visor member group 50 is shown in an open position in FIG. 6B with telescoping sections 50*a* and 50*b* shown fully extended. The number of telescoping sections is not restricted to two, but may include three or more in accordance with the design needs of the headgear. The space between the two visor lid members 50 and 51** may include any of the previously described features such as pop-up displays, storage, electronic components, etc.

Other objects, features and further scope of applicability of the present invention are apparent from the foregoing description and it is understood that the detailed specification and specific embodiments described herein, while setting forth preferred embodiments of the invention, are given by way of illustration only, since various changes and modifications within the spirit and scope of the appended claims will become apparent to those skilled in the art.

What is claimed is:

1. Headgear, comprising:

a lower visor lid member and a flexible upper visor lid member connected to one another in a region where both members are attached to the headgear, said upper visor lid member being flexible and weakened along an area which enables the flexible upper visor lid member to be separated from the lower visor lid member to an open position, said flexible upper visor lid member including a protruding portion of the visor lid member that overlaps said lower visor lid member when the visor lid members are closed on one another, thereby enabling said protruding portion to be grasped by the wearer so that the flexible upper lid member may be separated from the lower visor lid member;

a storage space being provided between the closed upper and lower visor lid members for containing a display and/or for storage; and said lower visor member includes a protrusion formed thereon in the region near where said upper and lower visor lid members are attached so that a lower portion of the upper visor lid member pushes against and over said protrusion upon opening of said upper visor lid member to maintain the flexible upper visor lid member in an open position.

2. Headgear as claimed in claim 1, wherein said upper visor lid member is partially maintained open by the flexibility and shape of said upper visor lid member.

3. Headgear as claimed in claim 1, wherein the upper visor lid member is maintained closed on the lower visor lid member by the flexibility of the upper visor lid member.

4. Headgear as claimed in claim 1, wherein said upper visor lid member includes telescoping lid members.

5. Headgear as claimed in claim 1, further comprising fastening means for retaining said upper and lower visor lid members closed.

6. Headgear as claimed in claim 5, wherein said fastening means comprises cooperating magnetic catch members respectively attached to said upper and lower visor lid members to retain said lid members closed.

7. Headgear as claimed in claim 5, wherein said fastening means includes a VELCRO-type fastener having members respectively attached in cooperative relationship to said upper and lower visor lid members.

8. Headgear as claimed in claim 8, wherein said fastening means includes a plurality of male/female snap connectors with each of the male and female portions thereof respectively mounted to a portion of the lower and upper visor lids to be in engaging relationship when the upper visor and lower visor members are closed.

9. Headgear, comprising:

a lower visor lid member and a flexible upper visor lid member connected to one another in a region where both members are attached to the headgear, said upper visor lid member being flexible and weakened along an area which enables the flexible upper visor lid member to be separated from the lower visor lid member to an open position, said flexible upper visor lid member including a protruding portion of the visor lid member that overlaps said lower visor lid member when the visor lid members are closed on one another, thereby enabling said protruding portion to be grasped by the wearer so that the flexible upper lid member may be separated from the lower visor lid member;

a storage space being provided between the closed upper and lower visor lid members for containing a display and/or for storage; and at least two speed bumps formed on said lower visor lid member and spaced from one another along the width of said lower visor member in a region below the weakened area of said upper visor member so that a lower portion of the upper visor lid member pushes against and over said at least two speed bumps upon opening of said upper visor lid member to flip-up and maintain the flexible upper visor lid member in an open position.

10. Headgear as claimed in claim 9, wherein said upper visor lid member is partially maintained open by the flexibility and shape of said upper visor lid member.

11. Headgear as claimed in claim 9, wherein the upper visor lid member is maintained closed on the lower visor lid member by the flexibility of the upper visor lid member.

12. Headgear as claimed in claim 9, wherein said upper visor lid member includes telescoping lid members.

13. Headgear as claimed in claim 9, further comprising fastening means for retaining said upper and lower visor lid members closed.

14. Headgear as claimed in claim 13, wherein said fastening means comprises cooperating magnetic catch members respectively attached to said upper and lower visor lid members to retain said lid members closed.

15. Headgear as claimed in claim 13, wherein said fastening means includes a VELCRO-type fastener having members respectively attached in cooperative relationship to said upper and lower visor lid members.

16. Headgear as claimed in claim 13, wherein said fastening means includes a plurality of male/female snap connectors with each of the male and female portions thereof respectively mounted to a portion of the lower and upper visor lids to be in engaging relationship when the upper visor and lower visor members are closed.

* * * * *